US007510129B2

(12) United States Patent
Kuronita et al.

(10) Patent No.: US 7,510,129 B2
(45) Date of Patent: Mar. 31, 2009

(54) FUEL INJECTION NOZZLE

(75) Inventors: Tokuji Kuronita, Obu (JP); Satoru Sasaki, Kariya (JP); Kanehito Nakamura, Ichinomiya (JP); Masumi Kinugawa, Okazaki (JP)

(73) Assignee: DENSO Corporation, Kariya (JP)

( * ) Notice: Subject to any disclaimer, the term of this patent is extended or adjusted under 35 U.S.C. 154(b) by 438 days.

(21) Appl. No.: 11/266,188

(22) Filed: Nov. 4, 2005

(65) Prior Publication Data

US 2006/0097077 A1 May 11, 2006

(30) Foreign Application Priority Data

Nov. 5, 2004 (JP) ..... 2004-322644
Sep. 21, 2005 (JP) ..... 2005-274622

(51) Int. Cl.
*B05B 1/14* (2006.01)
*B05B 1/30* (2006.01)

(52) U.S. Cl. ..... 239/556; 239/584; 239/89; 239/91

(58) Field of Classification Search ..... 239/556, 239/557, 566, 558, 560, 533.2, 584, 554, 239/533.12, 89, 91, 585.5, 567
See application file for complete search history.

(56) References Cited

U.S. PATENT DOCUMENTS

| | | | | |
|---|---|---|---|---|
| 4,106,702 | A | 8/1978 | Gardner et al. | |
| 6,047,905 | A | 4/2000 | Honda et al. | |
| 6,378,792 | B2 | 4/2002 | Fukaya et al. | |
| 6,783,087 | B2 * | 8/2004 | Aoki et al. | 239/596 |
| 7,059,547 | B2 * | 6/2006 | Kobayashi et al. | 239/533.12 |
| 7,100,848 | B2 * | 9/2006 | Kobayashi et al. | 239/596 |

FOREIGN PATENT DOCUMENTS

| | | |
|---|---|---|
| JP | 62-87665 | 4/1987 |
| JP | 9-88766 | 3/1997 |
| JP | 2001-165017 | 6/2001 |

* cited by examiner

*Primary Examiner*—Davis D Hwu
(74) *Attorney, Agent, or Firm*—Nixon & Vanderhye P.C.

(57) ABSTRACT

In a fuel injection nozzle including multiple nozzle hole groups each having multiple solitary nozzle holes, a group distance C between two of the nozzle hole groups is 0.8 or more times larger than an in-group hole distance α in a nozzle hole group. The group distance C is the minimum interval of inter-group intervals that are formed between (i) peripheral boundaries of solitary nozzle holes belonging to a first nozzle hole group and (ii) peripheral boundaries of solitary nozzle holes belonging to a second nozzle hole group adjacent to the first nozzle hole group. The in-group hole distance α is the minimum of intervals between peripheral boundaries belonging to each nozzle hole group.

9 Claims, 11 Drawing Sheets

$C = \alpha$ $C = \alpha$ $C = \alpha$

C= α

$C = \alpha$

C= α

C > α

FUEL INJECTION NOZZLE

CROSS REFERENCE TO RELATED APPLICATION

This application is based on and incorporates herein by reference Japanese patent applications No. 2004-322644 filed on Nov. 5, 2004 and No. 2005-274622 filed on Sep. 21, 2005.

FIELD OF THE INVENTION

The present invention relates to a fuel injection nozzle for injecting and supplying fuel to an internal combustion engine.

BACKGROUND OF THE INVENTION

A conventional fuel injection nozzle for injecting and supplying fuel to an internal combustion engine has a body in which a nozzle hole is formed and a needle functioning as a valve element by opening and closing the nozzle hole. When an electromagnetic valve as an actuator operates a cylinder of the internal combustion engine is supplied with the fuel from the fuel injection nozzle.

Some of the conventional fuel injection nozzles have a nozzle hole group in which two or more solitary nozzle holes are located close to each other in order to improve diffusibility of the injected fuel, as described in JP-H9-88766 A and JP-S62-87665 A. In the nozzle hole group, solitary sprays from the solitary nozzle holes collide and interfere with each other. Thus, a group spray from the nozzle hole group is formed by the collision and the interference of the solitary sprays. The group spray improves penetration performance of the injected fuel toward the direction of the injection and the diffusibility of the injected fuel.

Recently, in order to increase an amount of the fluid injected per unit time, a fuel injection nozzle with more nozzle hole groups is under consideration. However, a negative effect caused by closeness between the neighboring nozzle hole groups becomes significant, as the number of the nozzle hole group increases too much.

Distances between the nozzle hole groups decrease as the number of the nozzle hole groups is increased so as to increase the amount of the injected fuel. A competition area from which the fuel is supplied to adjoining multiple nozzle hole groups enlarges as the distance between the nozzle hole groups becomes shorter.

As the competition area enlarges, pressures of the fuel entering the relevant adjoining nozzle hole groups decrease. This causes atomizing the fuel to become difficult and thereby black smoke to be increased. In addition, a distance between group sprays becomes shorter and therefore amounts of airs introduced to the group sprays become smaller. As a result, the black smoke further increases.

SUMMARY OF THE INVENTION

It is therefore an object of the present invention to provide a fuel injection nozzle having multiple nozzle hole groups in which generation of black smoke is suppressed and therefore achieves high performance of an engine.

To achieve the above object, a fuel injection nozzle for injecting fuel into an internal combustion engine is provided with the following. A body is included to have a plurality of nozzle hole groups that include a first nozzle hole group and a second nozzle hole group adjacent to the first nozzle hole group. Here, each of the nozzle hole groups includes at least two solitary nozzle holes, wherein each of the solitary nozzle holes opens at an interior mouth on an interior surface of the body. Further, a valve element is included to be movable in the body for opening and closing the solitary nozzle holes. An in-group hole distance $\alpha$ is defined to be a minimum interval among intra-group intervals that are formed between peripheral boundaries of interior mouths included within each one group of the nozzle hole groups. A group distance C is defined to be a minimum interval among inter-group intervals that are formed between (i) individual peripheral boundaries of interior mouths included in the first nozzle hole group and (ii) individual peripheral boundaries of interior mouths included in the second nozzle hole group. Here, the group distance C is 0.8 or more times as large as the in-group hole distance $\alpha$.

With reference to FIGS. 11 and 12, a definition is given to the group distance C between adjoining nozzle hole groups 101 and 102 and to an in-group hole distance $\alpha$ of a nozzle hole group.

As shown in FIGS. 11 and 12, three solitary nozzle holes 101*a* to 101*c* belonging to a first nozzle hole group 101 are arranged so that inner mouths of the solitary nozzle holes 101*a* to 101*c* opening on an interior surface of the body of the fuel injection valve form three apexes of an equilateral triangle. Likewise, three solitary nozzle holes 102*a* to 102*c* belonging to a second nozzle hole group 102 are arranged so that interior mouths of the solitary nozzle holes 102*a* to 102*c* opening on an interior surface of the body form three apexes of another equilateral triangle.

The group distance C is defined to be the minimum of inter-group intervals that are formed between (i) peripheral boundaries of the interior mouths of the solitary nozzle holes 101*a* to 102*c* belonging to the first nozzle hole group 101 and (ii) peripheral boundaries of the interior mouths of the solitary nozzle holes 102*a* to 102*c* belonging to the second nozzle hole group 102.

The in-group hole distance $\alpha$ of a specific nozzle hole group is defined to be the minimum of intra-group intervals that are formed between peripheral boundaries of the interior mouths of the solitary nozzle holes included in the specific nozzle hole group.

A competition area Z from which the fuel is supplied to both the first nozzle hole group 101 and the second nozzle hole group 102 enlarges as the distance C becomes shorter. In FIG. 11, the group distance C equals the in-group hole distance $\alpha$ of the nozzle hole group 102. In FIG. 12, the group distance C is far shorter than the in-group hole distance $\alpha$ of the nozzle hole group 102.

As a result of intensive investigation of the inventors, relations regarding a non-dimensional number $C/\alpha$ are obtained as shown in FIG. 9. A graph (a) in FIG. 9 shows a relation between a specific hole inflow amount and the non-dimensional number $C/\alpha$. The specific hole inflow amount indicates an amount of the fuel flowing into a solitary nozzle hole located at an end of the group distance C. A graph (b) in FIG. 9 shows a relation between a black smoke increase ratio and the non-dimensional number $C/\alpha$. The black smoke increase ratio indicates a ratio of an amount of generated black smoke relative to an amount when the group distance C is sufficiently larger than the in-group hole distance $\alpha$.

As shown in (a) of FIG. 9, the specific hole inflow amount is constant while the non-dimensional number $C/\alpha$ is within a range larger than 0.8; the specific hole inflow amount decreases with decreasing non-dimensional number $C/\alpha$ while the non-dimensional number $C/\alpha$ is in a range less than 0.8. In other words, the specific hole inflow amount decreases as the group distance C becomes smaller relative to the in-group hole distance $\alpha$ in the range less than 0.8 of $C/\alpha$.

According to characteristics shown in (b) of FIG. 9, the black smoke increase ratio is constant while the non-dimensional number $C/\alpha$ is within a range larger than 0.8; the black smoke increase ratio increases exponentially with decreasing non-dimensional number $C/\alpha$ while $C/\alpha$ is within a range less than 0.8. In other words, the black smoke increase ratio increases exponentially as the group distance C becomes smaller relative to the in-group hole distance $\alpha$ in the range less than 0.8 of $C/\alpha$.

In other words, if the group distance C falls within a range of 0.8 times or more as large as the in-group hole distance $\alpha$, the specific hole inflow amount does not decrease and the black smoke increase ratio does not increase. Therefore, if the group distance C equals the in-group hole distance $\alpha$, increase of the black smoke may be prevented and the high output performance of the engine can be achieved.

In addition, the solitary nozzle holes of the first nozzle hole group and the solitary nozzle holes of the second nozzle hole group may be aligned rotationally symmetrically with each other. Therefore, the dead space between the first and second nozzle hole groups can be reduced, by appropriately adjusting rotation angle of the first nozzle hole group relative to the second nozzle hole group.

In addition, at least two of the multiple nozzle hole groups may be deviated along an axial direction of the body. Therefore, the dead space between the first and second nozzle hole groups can be reduced, by appropriately adjusting arrangement of nozzle hole groups along the axial direction.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE INVENTION

First Embodiment

Figure 1:
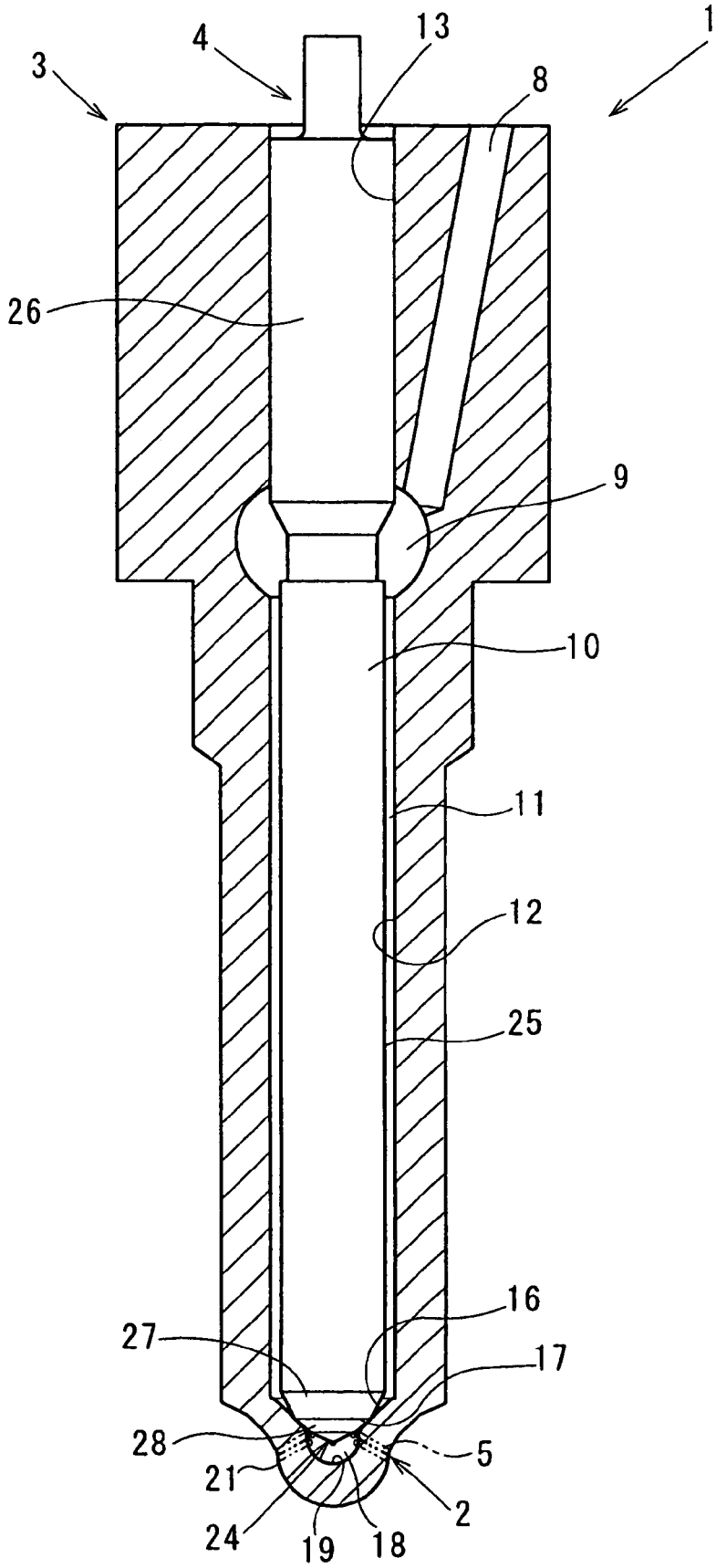
FIG. 1 is a cross-sectional view of a fuel injection nozzle according to a first embodiment of the present invention.

As shown in FIG. 1, a fuel injection nozzle 1 of a first embodiment includes a body 3 and a needle 4 and is supported by a nozzle holder (not shown). The body 3 includes multiple nozzle hole groups 2. The needle 4 functions as a valve element which is incorporated in the body 3, being allowed to move in the body 3 to open and close the nozzle hole groups 2. The nozzle 1 constitutes a fuel injection valve together with an electromagnetic valve (not shown) operating in response to commands from an ECU. The fuel injection valve is located close to each cylinder of a multi-cylinder diesel engine and used to inject and supply fuel into the cylinder.

Each nozzle hole group 2 is formed by arranging two or more solitary nozzle holes 5 close to each other. The nozzle hole group 2 is designed to help atomization of the fuel by reducing the diameters of the solitary nozzle holes 5 and by increasing the number of the solitary nozzle holes 5, and to improve penetration performance of the fuel toward the direction of the injection by gathering the solitary nozzle holes 5 closely and therefore by producing a group spray through collisions and interferences of solitary sprays injected by the solitary nozzle holes 5.

The fuel to be injected from the nozzle 1 is compressed and delivered in advance by a well-known injection pump (not shown), and is supplied to the fuel injection valve through a well-known common rail (not shown). When the electromagnetic valve operates, the needle 4 is driven toward a direction for opening the nozzle hole groups 2 to execute the injection of the fuel. When the electromagnetic valve stops its operation, the needle 4 is driven toward a direction for closing the nozzle hole groups 2 to stop the injection of the fuel.

The body 3 includes a fuel supply path 8, a fuel sump 9, a guide hall 12, and a slide hole 13. The fuel supply path 8 guides the fuel from the common rail to the fuel sump 9. The guide hall 12 is formed along the axis of the nozzle 1, houses a main body 10 of the needle 4, and forms a fuel path 11 from the fuel sump 9 to the nozzle hole groups 2. The slide hole 13 supports the main body 10 allowing it to slide along the axis.

A seat surface 16 with a conical shape is formed at a tip side end (i.e. the opposite side end to the fuel sump 9) of the guide hall 12 and tapers toward the tip side end. A seat portion 17 of the needle 4 repeats seating on and leaving the seat surface 16. A sack room 18 is recessed at the tip side end of the seat surface 16. Interior mouths 20 of the nozzle hole groups 2 are located on an interior surface 19 forming the sack room 18. When departure of the seat portion 17 from the seat surface 16 opens the nozzle hole groups 2, the injection of the fuel starts. When seating of the seat portion 17 on the seat surface 16 closes the nozzle hole groups 2, the injection of the fuel stops.

Figure 2A:
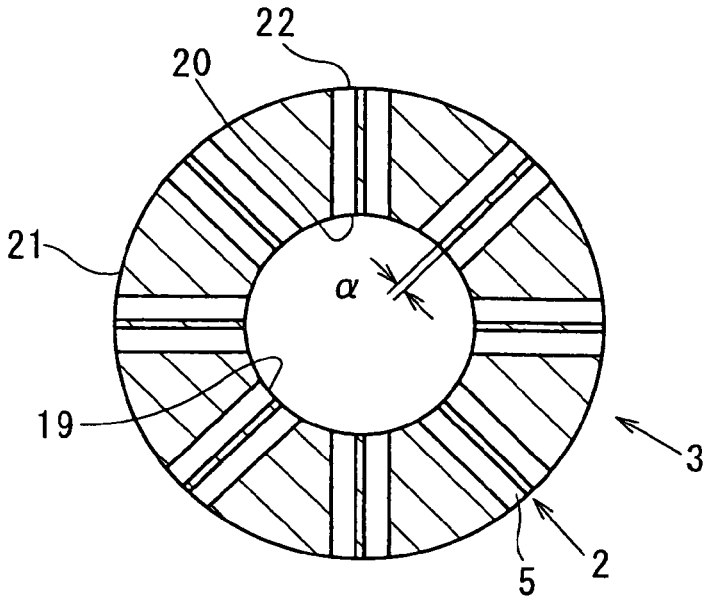
FIG. 2A is a cross-sectional view perpendicular to the axis of the fuel injection nozzle, showing a main portion of the nozzle.

As shown in FIG. 2A, the nozzle hole groups 2 are formed radially with respect to the axis of the nozzle 1 or the body 3 with intervals of a constant angle so that an interval between a portion of one of the nozzle hole groups 2 and a portion of another one of the nozzle hole groups 2 gets longer as the portions get away from the interior surface 19 of the body 3 and get close to the exterior surface 21 of the body 3. The solitary nozzle holes 5 in each of the nozzle hole groups 2 are formed parallel to each other.

Figure 2B:
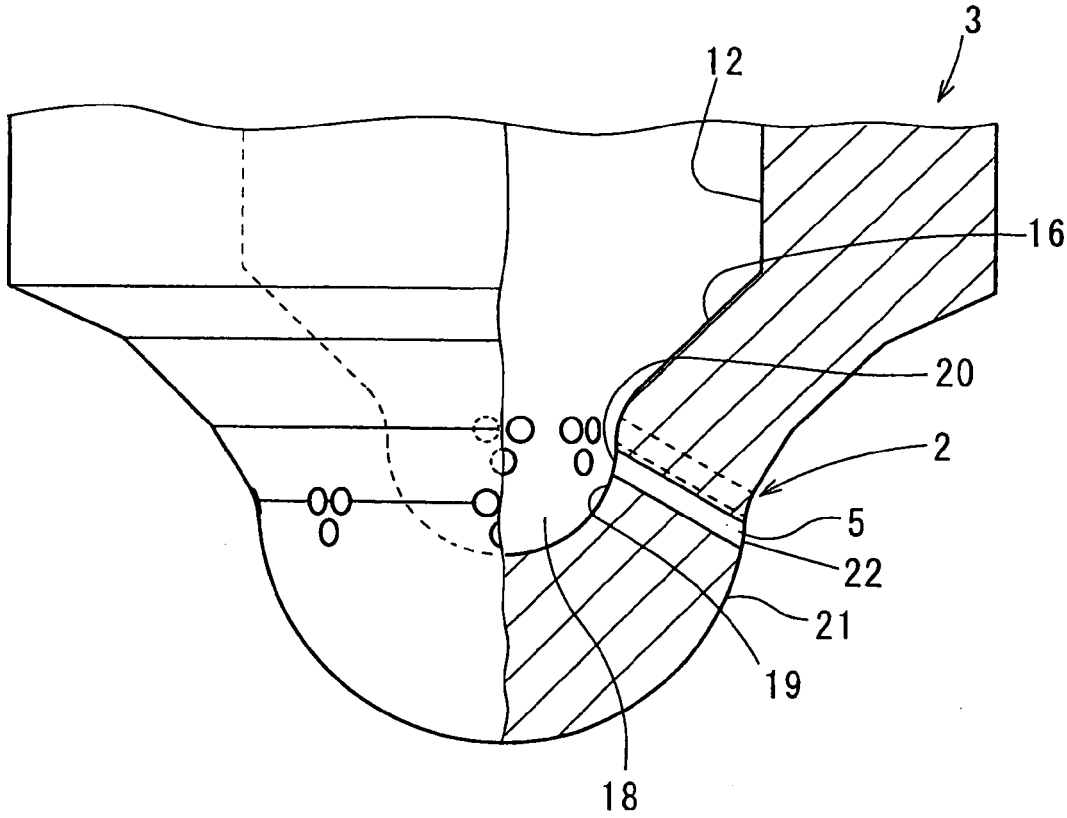
FIG. 2B is a cross-sectional view along the axis of the fuel injection nozzle, showing the main portion of the nozzle.

As shown in FIG. 2B, a portion of each solitary nozzle hole 5 gets closer to the tip of the nozzle 1 as it gets closer to the exterior of the body 3. Therefore each exterior mouth 22 at the exterior end of each solitary nozzle hole 5 is closer to the tip of the nozzle 1 than a corresponding interior mouth 20 belonging to the same solitary nozzle hole 5 as exterior mouth 22. An inner diameter of each interior mouth 20 is as long as an inner diameter of the corresponding exterior mouth 22, which is referred to as a mouth inner diameter d.

As shown in FIG. 1, the needle 4 includes a tip portion 24 formed on the tip of the main body 10, as well as the main body 10 with a cylindrical shape. The peripheral surface 25 of the main body 10 forms the fuel path 11 together with the guide hall 12. A portion of main body 10 near a rear side end (i.e. the end opposite to the tip side end of the main body 10) constitutes a sliding axis portion 26 which slides in contact with the slide hole 13. The tip portion 24 includes two conical surfaces 27 and 28 which taper toward the tip of the needle 4. A ridge (or boundary) between the conical surfaces 27 and 28 constitutes the seat portion 17.

Characteristics of First Embodiment

Figure 3A:
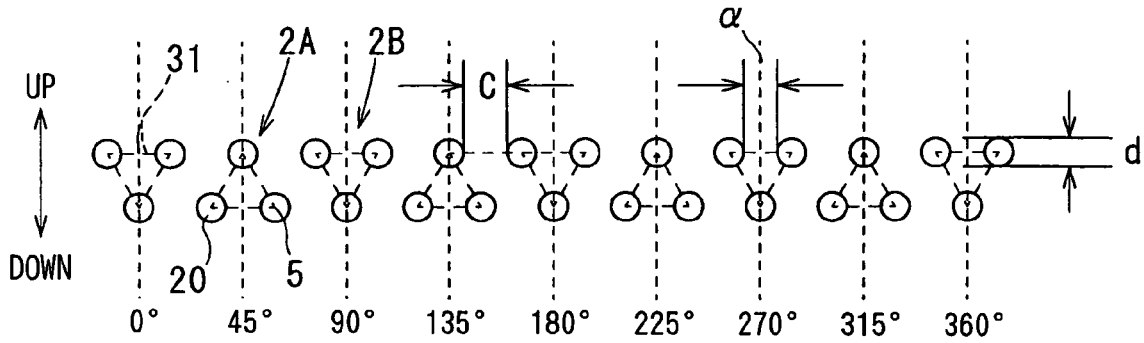
FIGS. 3A and 3B are expansion views showing arrangement of nozzle hole groups on an interior surface of the nozzle.
Figure 3B:
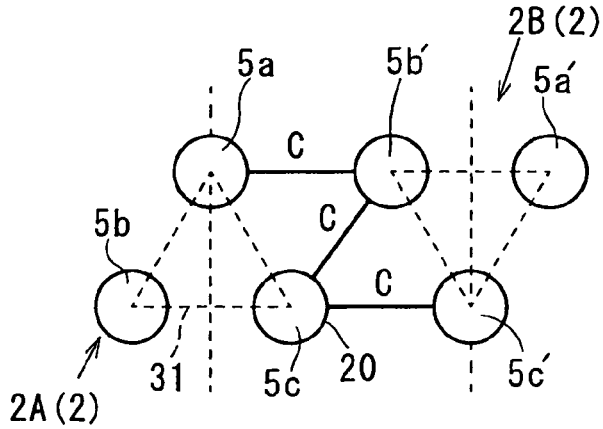

Each of the nozzle hole groups 2 of the present embodiment consists of three solitary nozzle holes 5. As shown in FIGS. 3A and 3B, the interior mouths 20 belonging to the same nozzle hole group 2 form an equilateral triangle. In other words, the interior mouths 20 belonging to the same nozzle hole group 2 forms the three apexes of an equilateral triangle.

Among all the nozzle hole groups 2, nozzle hole groups 2 each of which forms a triangle 31 projecting downward are referred to as first nozzle hole groups 2A. Among all the nozzle hole groups 2, nozzle hole groups 2 each of which is adjacent to one of the first nozzle hole groups 2A and forms a triangle 31 projecting upward is referred to as second nozzle hole groups 2B.

In other words, among all the nozzle hole groups 2, nozzle hole groups 2 each of which forms three apexes of an equilateral triangle with one of the apexes right under the center of the triangle is referred to as first nozzle hole groups 2A. In addition, among all the nozzle hole groups 2, nozzle hole groups 2 each of which is adjacent to one of the first nozzle hole groups 2A and forms three apexes of an equilateral triangle with one of the apexes right below the center of the triangle is referred to as second nozzle hole groups 2B.

Three solitary nozzle holes 5 belonging to one of the first nozzle hole groups 2A are referred to as solitary nozzle holes 5*a*, 5*b*, and 5*c*. In addition, three solitary nozzle holes 5 belonging to one of the second nozzle hole groups 2B are referred to as solitary nozzle holes 5*a*', 5*b*', and 5*c*'.

A group distance C is defined to be the minimum interval of all the intervals formed between (i) individual peripheral boundaries (or peripheral edge lines) of the interior mouths 20 of the solitary nozzle holes 5*a*-5*c* and (ii) individual peripheral boundaries of the interior mouths 20 of the solitary nozzle holes 5*a*'-5*c*'. Furthermore, an inter-group interval is defined to be an interval formed between (i) a peripheral boundary of an interior mouth 20 of a solitary nozzle of a certain nozzle hole group 2A and (ii) a peripheral boundary of an interior mouth 20 of a solitary nozzle of a given nozzle hole group 2B adjacent to the certain nozzle hole group 2A. Namely, the group distance C is also defined to be a minimum inter-group interval of all the inter-group intervals.

An in-group hole distance $\alpha$ is defined to be the minimum interval of all intra-group intervals that are formed between multiple peripheral boundaries of the interior mouths 20 of the solitary nozzle holes 5 belonging to the same nozzle hole group 2.

The locations of the solitary nozzle holes 5*a*-5*c* are rotationally symmetric with the locations of the solitary nozzle holes 5*a*'-5*c*'. Specifically, the solitary nozzle holes 5*a*-5*c* overlap the solitary nozzle holes 5*a*'-5*c*' respectively, by rotating the solitary nozzle holes 5*a*-5*c* by 60 degrees and then moving the rotated nozzle holes 5*a*-5*c* around the axis of the body 3 or the nozzle 1.

The group distance C equals the in-group hole distance $\alpha$. In addition, three inter-group intervals between the first nozzle hole group 2A and the second nozzle hole group 2B equal the group distance C. Specifically, as shown in FIG. 3B, the group distance C can be equally defined with respect to each of three inter-group intervals between the solitary nozzle hole 5*a* and the solitary nozzle hole 5*b*', between the solitary nozzle hole 5*b* and the solitary nozzle hole 5*b*', and between the solitary nozzle hole 5*b* and the solitary nozzle hole 5*c*'.

Operation of First Embodiment

Hereafter, operation of the nozzle 1 of the present embodiment will be described with reference to FIG. 1. When the electromagnetic valve starts its operation in response to the commands from the ECU, the needle 4 is driven to the direction for opening the nozzle hole groups 2. In other words, when the electromagnetic valve starts its operation, the seat portion 17 leaves the seat surface 16 to fluidly connect the nozzle hole groups 2 with the fuel path 11. Thus, the high-pressure fuel stored in the common rail is injected and supplied to the cylinders. When the electromagnetic valve stops its operation, the needle 4 is driven to the direction for closing the nozzle hole groups 2. In other words, when the electromagnetic valve starts its operation, the seat portion 17 seats on the seat surface 16 to shut off the nozzle hole groups 2 from the fuel path 11. Thus, the injection of the fuel to the cylinders stops.

Effect of First Embodiment

As described above, the nozzle 1 of the present embodiment includes the body 3 and the needle 4, wherein the body 3 includes the multiple nozzle hole groups 2, and the needle 4 functions as a valve element which is incorporated in the body 3, being allowed to move in the body 3 to open and close the nozzle hole groups 2. In addition, the group distance C equals the in-group hole distance $\alpha$.

Figure 9:
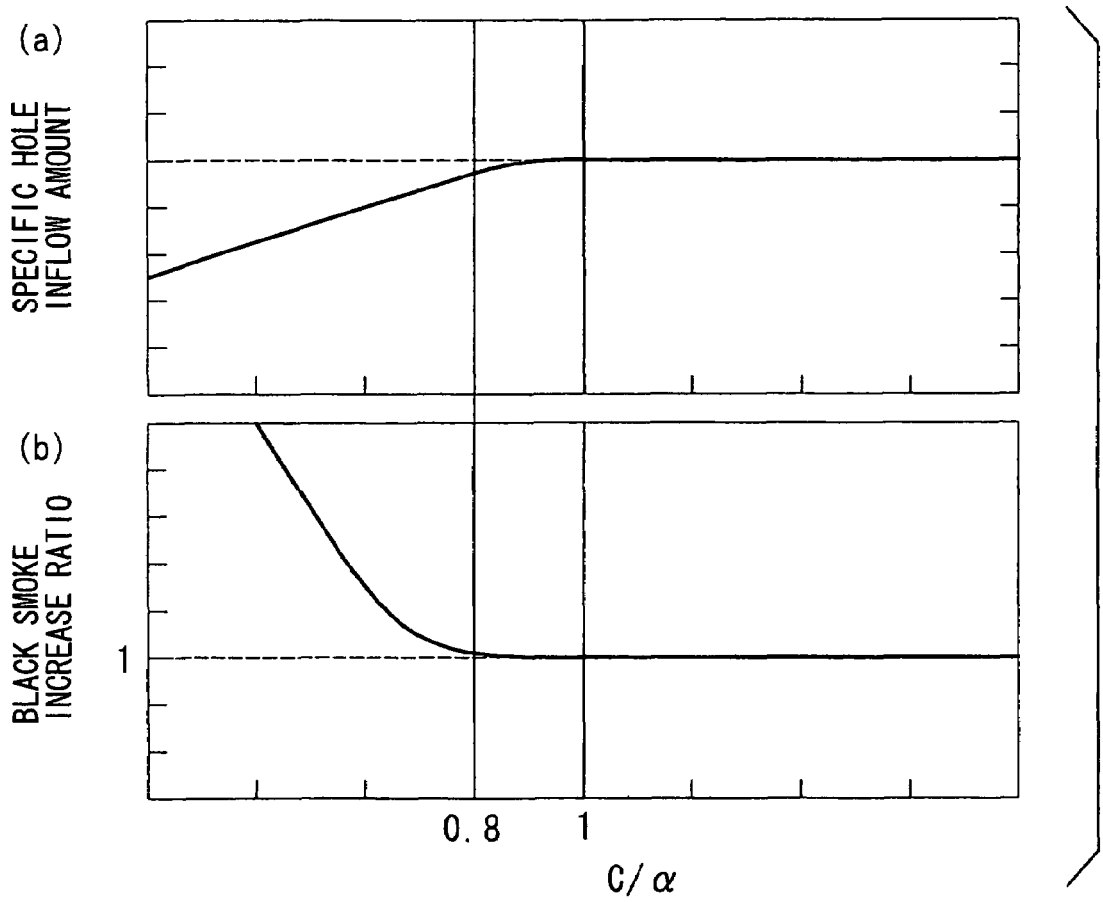
FIG. 9 is a correlation chart showing (a) a relation between a non-dimensional number $C/\alpha$ and an inflow amount to a specific nozzle hole and (b) a relation between a non-dimensional number $C/\alpha$ and an increase ratio of black smoke.

According to investigation of the inventors, a non-dimensional number $C/\alpha$ has characteristics shown in FIG. 9. According to the characteristics shown in (a) of FIG. 9, the specific hole inflow amount is constant while the non-dimensional number $C/\alpha$ is larger than 0.8; the specific hole inflow amount decreases with decreasing non-dimensional number $C/\alpha$ in a range below 0.8. In other words, the specific hole inflow amount decreases as the group distance C becomes smaller relative to the in-group hole distance $\alpha$ in the range below 0.8.

According to characteristics shown in (b) of FIG. 9, the black smoke increase ratio is constant while the non-dimensional number $C/\alpha$ is larger than 0.8; the black smoke increase ratio increases exponentially with decreasing the non-dimensional number $C/\alpha$ in a range below 0.8. In other words, the black smoke increase ratio increases exponentially as the group distance C becomes smaller relative to the in-group hole distance $\alpha$ in the range below 0.8.

In other words, if the group distance C is kept 0.8 or more times as large as the in-group hole distance α, the specific hole inflow amount does not decrease and the black smoke increase ratio does not increase. Therefore, if the group distance C equals the in-group hole distance α, increase of the black smoke can be avoided and the high output performance of the engine is achieved.

In addition, the three inter-group intervals between the first nozzle hole group 2A and the second nozzle hole group 2B equal the group distance C. The group distance C is the minimum interval between the individual interior mouths 20 belonging to a certain nozzle hole group 2 (i.e. the first nozzle hole group 2A) and the individual interior mouths 20 belonging to another nozzle hole group 2 (i.e. the second nozzle hole group 2B) adjacent to the certain nozzle hole group 2. Therefore, that many inter-group intervals equal the group distance C means that an interval between the two groups becomes at its minimum in many paths. It can be also said that a dead space between the two neighboring nozzle hole groups 2 becomes smaller as the numbers of inter-group intervals equaling the group distance C increase.

Therefore, by arranging the nozzle hole groups 2 and the solitary nozzle holes 5 in the nozzle hole groups 2 to obtain more inter-group intervals equaling the group distance C, the dead space can be more effectively diminished and therefore the number of the nozzle hole groups 2 can be increased. In the case that each nozzle hole group 2 includes three or more solitary nozzle holes 5, the number of inter-group intervals equaling the group distance C has been conventionally (N−2) at a maximum, where N is the number of the solitary nozzle hole 5 in each nozzle hole group 2. Therefore, by arranging the nozzle hole groups 2 and solitary nozzle holes 5 to make the number of inter-group intervals equaling the group distance C be (N−1) or more, the dead space can be diminished more effectively than ever and the number of the nozzle hole groups 2 can be increased than ever.

In the nozzle 1 of the first embodiment in which each nozzle hole group 2 has three solitary nozzle holes 5, the three inter-group intervals equal the group distance C. Therefore, the nozzle 1 can diminish the dead space and increase the number of the nozzle hole groups 2 than ever.

In addition, the nozzle hole groups 2 are arranged so that a portion of one of the nozzle hole groups 2 and a portion of another one of the nozzle hole groups 2 gets away radially from each other as they go from the interior surface 19 to the exterior surface 21. Therefore, the exterior mouths 22 of the first nozzle hole group 2A and the exterior mouths 22 of the second nozzle hole group 2B are located apart from each other, a group spray from the first nozzle hole group 2A and a group spray from the second nozzle hole group 2B are formed in directions away from each other. Thus, interference between the group sprays can be suppressed.

In the nozzle 1, the arrangement of the solitary nozzle holes 5*a*-5*c* and the arrangement of the solitary nozzle holes 5*a*'-5*c*' are rotationally symmetric. Therefore, the dead space between the first and second nozzle hole groups 2 can be reduced.

Second Embodiment

Characteristics of Second Embodiment

Figure 4A:
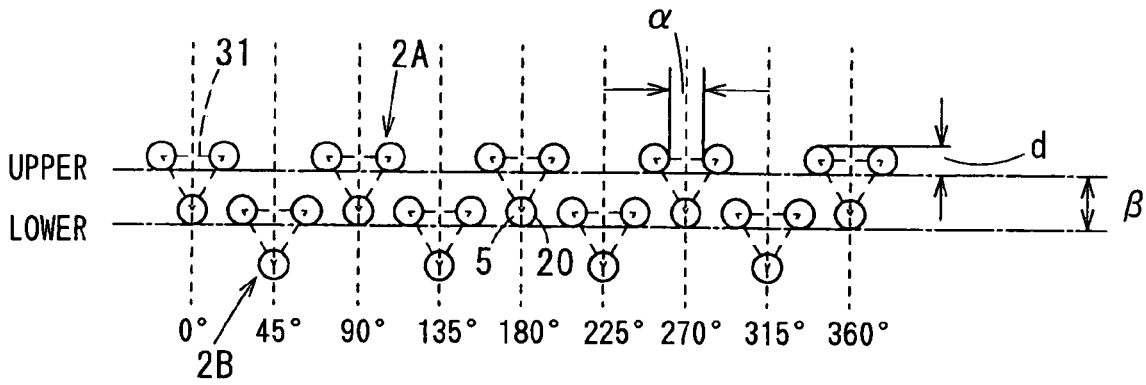
FIGS. 4A and 4B are expansion views showing arrangement of nozzle hole groups on an interior surface of a fuel injection nozzle according to a second embodiment of the present invention.
Figure 4B:
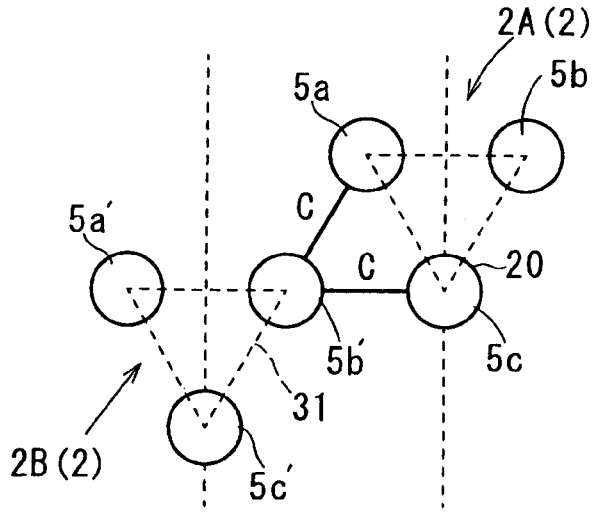

A fuel injection nozzle 1 of a second embodiment differs from the fuel injection nozzle 1 of the first embodiment in that the nozzle hole groups 2 of the nozzle 1 of the second embodiment are arranged as shown in FIGS. 4A and 4B.

In every nozzle hole group 2 of the second embodiment, three solitary nozzle holes 5 are arranged so that their interior mouths 20 form apexes of an equilateral triangle 31 projecting right downward. In addition, any two neighboring nozzle hole groups 2 of the nozzle hole groups 2 are deviated toward the axial direction of the nozzle 1. Specifically, the nozzle hole groups 2 are arranged so that the nozzle hole groups 2 open their interior mouths 20 on an upper circumference and a lower circumference alternately.

Each nozzle hole group 2 whose interior mouths 20 are located on the upper circumference is referred to as a first nozzle hole group 2A. Each nozzle hole group 2 whose interior mouths 20 are located on the lower circumference is referred to as a second nozzle hole group 2B. The three solitary nozzle holes 5 belonging to the same first nozzle hole group 2A are referred to as solitary nozzle holes 5*a*, 5*b*, and 5*c*. The three solitary nozzle holes 5 belonging to the same second nozzle hole group 2B are referred to as solitary nozzle holes 5*a*', 5*b*', and 5*c*'.

In this case, two inter-group intervals between the first nozzle hole group 2A and the second nozzle hole group 2B adjacent to the first nozzle hole group 2A equal the group distance C. The two inter-group intervals are intervals between the solitary nozzle hole 5*a* and the solitary nozzle hole 5*b*' and between the solitary nozzle hole 5*c* and the solitary nozzle hole 5*b*'.

In addition, the group distance C equals the in-group hole distance α. The mouth inner diameter d, the in-group hole distance α, and the amount β of deviation or bias along the axial direction between the neighboring nozzle hole groups 2A and 2B have a relation represented by an equation $$\beta=\cos 30^\circ\times(\alpha+d).$$

Effect of Second Embodiment

As described above, the nozzle hole groups 2 are arranged so that the nozzle hole groups 2 open their interior mouths 20 on the upper circumference and the lower circumference alternately. Therefore, the dead space between the neighboring nozzle hole groups 2 can be diminished. In addition, the number of the nozzle hole groups 2 can be increased without reducing a distance between group sprays from the first nozzle hole group 2A and the second nozzle hole group 2B. Therefore, the number of the nozzle hole groups 2 can be increased without reducing an amount of air mixed to each group spray.

Third Embodiment

Figure 5A:
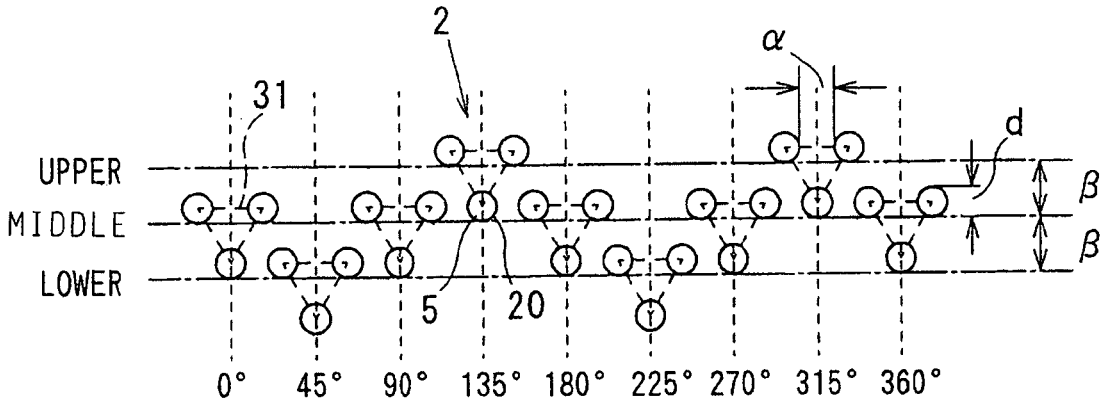
FIGS. 5A and 5B are expansion views showing arrangement of nozzle hole groups on an interior surface of a fuel injection nozzle according to a third embodiment of the present invention.
Figure 5B:
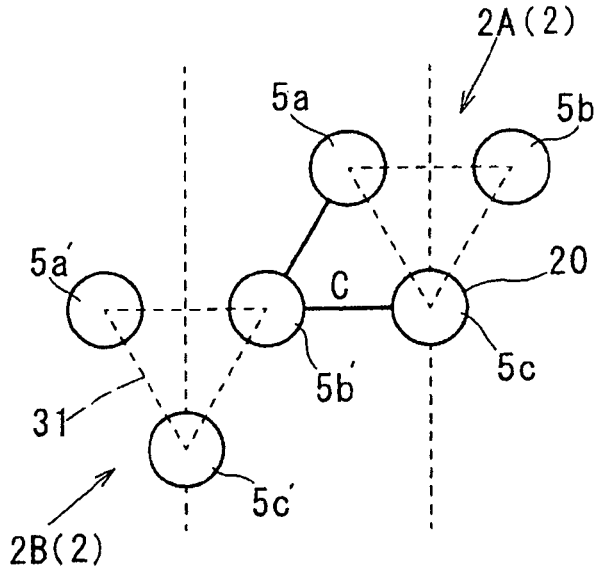

A fuel injection nozzle 1 of a third embodiment differs from the fuel injection nozzle 1 of the first embodiment in that the nozzle hole groups 2 of the nozzle 1 of the third embodiment are arranged as shown in FIGS. 5A and 5B.

In every nozzle hole group 2 of the third embodiment, solitary nozzle holes 5 are arranged so that their interior mouths 20 form apexes of an equilateral triangle 31 projecting downward. In addition, the nozzle hole groups 2 are aligned around the axis of the nozzle 1 with their interior mouths 20 on an upper circumference, a middle circumference, and a lower circumference in an order of the upper circumference, the middle circumference, the lower circumference, the middle circumference, and the upper circumference.

Each nozzle hole group 2 whose interior mouths 20 are at the upper side of two neighboring nozzle hole groups 2 is referred to as a first nozzle hole group 2A. Each nozzle hole group 2 whose interior mouths 20 are at the lower side of the two neighboring nozzle hole groups 2 is referred to as a second nozzle hole group 2B. The three solitary nozzle holes 5 belonging to the first nozzle hole group 2A are referred to as solitary nozzle holes 5*a*, 5*b*, and 5*c*. The three solitary nozzle holes 5 belonging to the second nozzle hole group 2B are referred to as solitary nozzle holes 5*a*', 5*b*', and 5*c*'.

In this case, two inter-group intervals between the first nozzle hole group 2A and the second nozzle hole group 2B equal the group distance C. The two inter-group intervals are intervals between the solitary nozzle hole 5*a* and the solitary nozzle hole 5*b*' and between the solitary nozzle hole 5*c* and the solitary nozzle hole 5*b*'.

In addition, the group distance C equals the in-group hole distance α. The mouth inner diameter d, the in-group hole distance α, and the amount β of deviation along the axial direction between the nozzle hole group 2A on the upper circumference and its neighboring nozzle hole group 2B at the middle circumference have a relation represented by an equation $\beta=\cos 30°\times(\alpha+d)$. Likewise, the mouth inner diameter d, the in-group hole distance α, and the amount β of deviation along the axial direction between the nozzle hole group 2A on the middle circumference and its neighboring nozzle hole group 2B at the lower circumference have a relation represented by an equation $\beta=\cos 30°\times(\alpha+d)$.

Fourth Embodiment

Figure 6A:
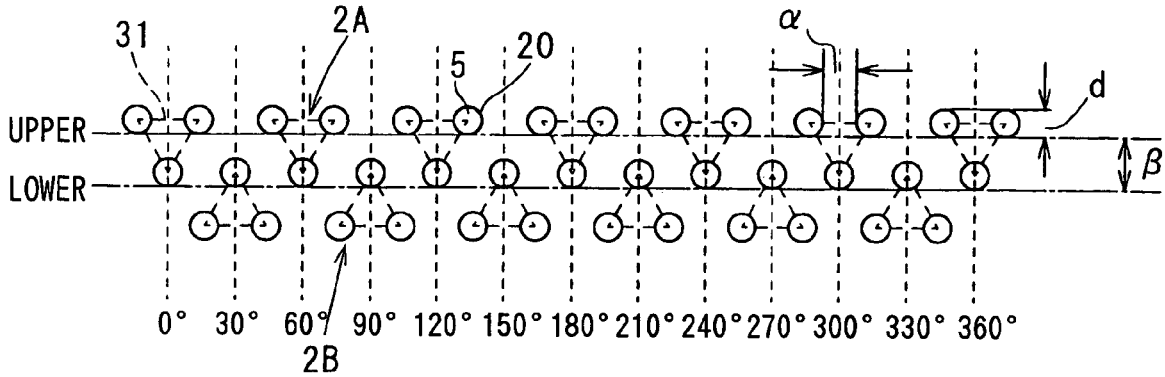
FIGS. 6A and 6B are expansion views showing arrangement of nozzle hole groups on an interior surface of a fuel injection nozzle according to a fourth embodiment of the present invention.
Figure 6B:
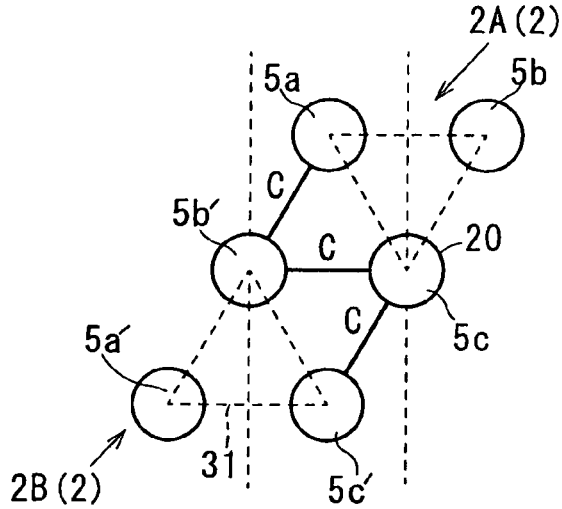

A fuel injection nozzle 1 of a fourth embodiment differs from the fuel injection nozzle 1 of the first embodiment in that the nozzle hole groups 2 of the nozzle 1 of the fourth embodiment are arranged as shown in FIGS. 6A and 6B. As shown in FIGS. 6A and 6B, the interior mouths 20 of the nozzle hole groups 2 are arranged on the upper circumference and the lower circumference alternately. In addition, solitary nozzle holes belonging to a certain nozzle hole group 2 on the upper circumference are aligned rotationally symmetrically with solitary nozzle holes belonging to another nozzle hole groups 2 which is adjacent to the certain nozzle hole group 2 and is on the lower circumference.

Among all the nozzle hole groups 2, each nozzle hole group 2 on the upper circumference is referred to as a first nozzle hole group 2A. Among all the nozzle hole groups 2, each nozzle hole group 2 which is adjacent to the first nozzle hole group 2A and is on the lower circumference is referred to as a second nozzle hole group 2B.

Three solitary nozzle holes 5 belonging to the first nozzle hole group 2A are referred to as solitary nozzle holes 5*a*, 5*b*, and 5*c*. In addition, three solitary nozzle holes 5 belonging to the second nozzle hole group 2B are referred to as solitary nozzle holes 5*a*', 5*b*', and 5*c*'. The solitary nozzle holes 5*a*-5*c* overlap the solitary nozzle holes 5*a*'-5*c*' respectively, by rotating the solitary nozzle holes 5*a*-5*c* by 60 degrees with respect to a center of the rotation symmetry and then moving the rotated nozzle holes 5*a*-5*c* around the axis of the body 3 or the nozzle 1.

In this case, three inter-group intervals between the first nozzle hole group 2A and the second nozzle hole group 2B equal the group distance C. The three inter-group intervals are intervals between the solitary nozzle hole 5*a* and the solitary nozzle hole 5*b*', between the solitary nozzle hole 5*c* and the solitary nozzle hole 5*b*', and between the solitary nozzle hole 5*c* and the solitary nozzle hole 5*c*'.

In addition, the group distance C equals the in-group hole distance α. The mouth inner diameter d, the in-group hole distance α, and the amount β of deviation along the axial direction between the nozzle hole groups 2A and 2B have a relation represented by an equation $\beta=\cos 30°\times(\alpha+d)$.

Fifth Embodiment

Characteristics of Fifth Embodiment

Figure 7A:
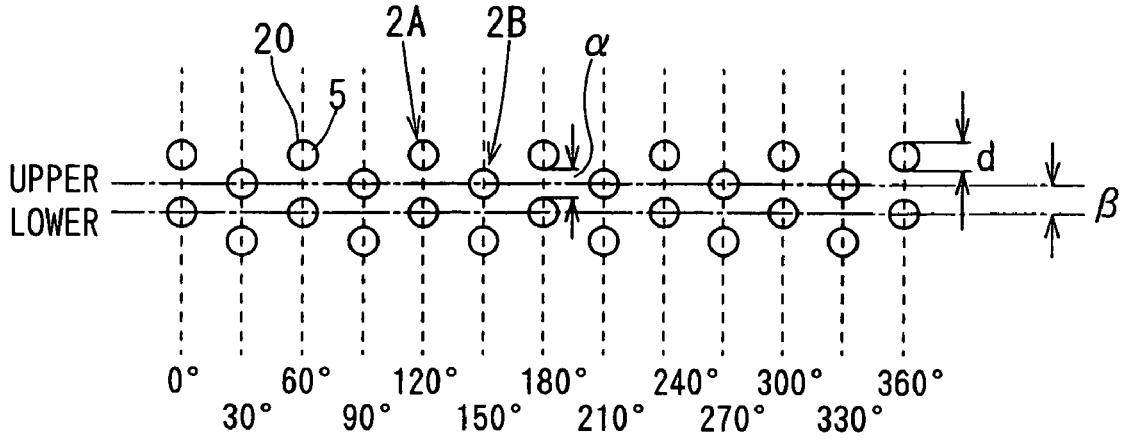
FIGS. 7A and 7B are expansion views showing arrangement of nozzle hole groups on an interior surface of a fuel injection nozzle according to a fifth embodiment of the present invention.
Figure 7B:
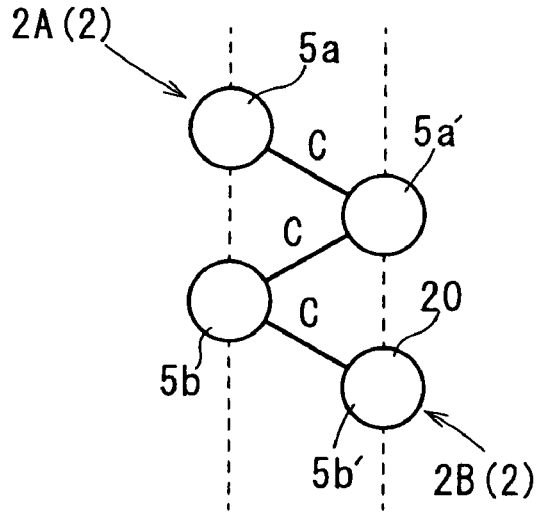

A fuel injection nozzle 1 of a fifth embodiment differs from the fuel injection nozzle 1 of the first embodiment in that the nozzle hole groups 2 of the nozzle 1 of the fifth embodiment are arranged as shown in FIGS. 7A and 7B.

Every nozzle hole group 2 of the third embodiment consists of two solitary nozzle holes 5 aligned around the axis of the nozzle 1. The nozzle hole groups 2 are aligned toward the axial direction of the nozzle 1 with their interior mouths 20 being arranged on an upper circumference and a lower circumference alternately.

Each nozzle hole group 2 whose the interior mouths 20 are located on the upper circumference is referred to as a first nozzle hole group 2A. Each nozzle hole group 2 whose interior mouths 20 are located on the lower circumference is referred to as a second nozzle hole group 2B. The three solitary nozzle holes 5 belonging to each first nozzle hole group 2A are referred to as solitary nozzle holes 5*a*, 5*b*, and 5*c*. The three solitary nozzle holes 5 belonging to each second nozzle hole group 2B are referred to as solitary nozzle holes 5*a*', 5*b*', and 5*c*'.

In this case, three inter-group intervals between the first nozzle hole group 2A and the second nozzle hole group 2B adjacent to the first nozzle hole group 2A equal the group distance C. The three inter-group intervals are intervals between the solitary nozzle hole 5*a* and the solitary nozzle hole 5*a*', between the solitary nozzle hole 5*b* and the solitary nozzle hole 5*a*', and between the solitary nozzle hole 5*b* and the solitary nozzle hole 5*b*'.

In addition, the group distance C equals the in-group hole distance α. The mouth inner diameter d, the in-group hole distance α, and the amount β of deviation along the axial direction between the neighboring nozzle hole groups 2A and 2B have a relation represented by an equation $\beta=0.5\times(\alpha+d)$.

Effect of Fifth Embodiment

As described above, the three inter-group intervals between the first nozzle hole group 2A and the second nozzle hole group 2B equal the group distance C. In the case that each nozzle hole group 2 includes two solitary nozzle holes 5, the number of inter-group intervals equaling the group distance C has been conventionally two at a maximum. Here, the nozzle hole groups 2 and solitary nozzle holes 5 are arranged to make the number of inter-group intervals equaling the group distance C be more than two. Therefore, the dead space can be diminished more effectively than ever and the number of the nozzle hole groups 2 can be increased than ever.

In addition, each nozzle hole group 2 has two solitary nozzle holes 5. Moreover, the mouth inner diameter d, the in-group hole distance α, and the deviation amount β have a relation represented by an equation $\beta=0.5\times(\alpha+d)$.

In the case that each nozzle hole group 2 has two solitary nozzle holes 5, the dead space between two nozzle hole groups 2 becomes smallest when the relation $\beta=0.5\times(\alpha+d)$ is satisfied. Therefore, by arranging the nozzle hole groups 2 to achieve the relation $\beta=0.5\times(\alpha+d)$, the dead space can be diminished.

In the case that each nozzle hole group 2 has two solitary nozzle holes 5 and the relation $\beta\geqq1.5\times(\alpha+d)$ is satisfied, the dead space becomes smaller as the deviation amount β becomes larger. Therefore, by arranging the nozzle hole groups 2 to achieve the relation $\beta\geqq1.5\times(\alpha+d)$, the dead space can be diminished.

Sixth Embodiment

Characteristics of Sixth Embodiment

Figure 8A:
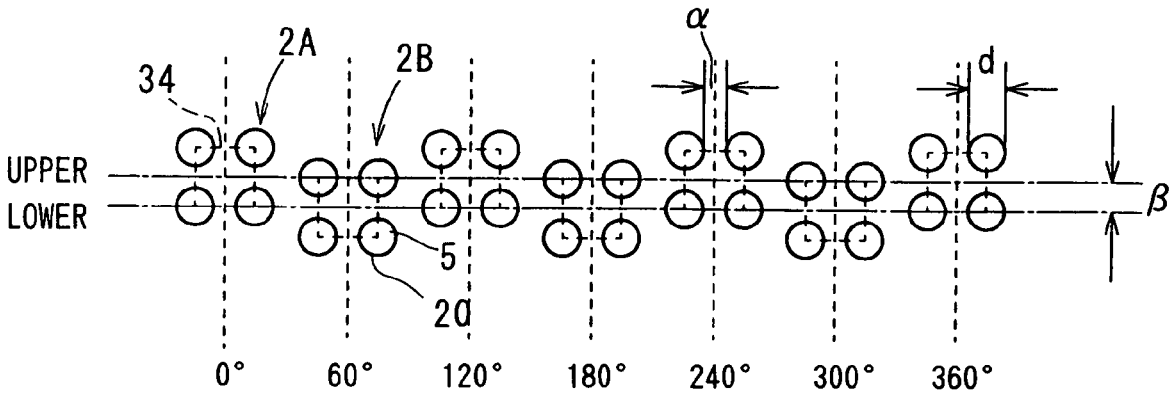
FIGS. 8A and 8B are expansion views showing arrangement of nozzle hole groups on an interior surface of a fuel injection nozzle according to a sixth embodiment of the present invention.
Figure 8B:
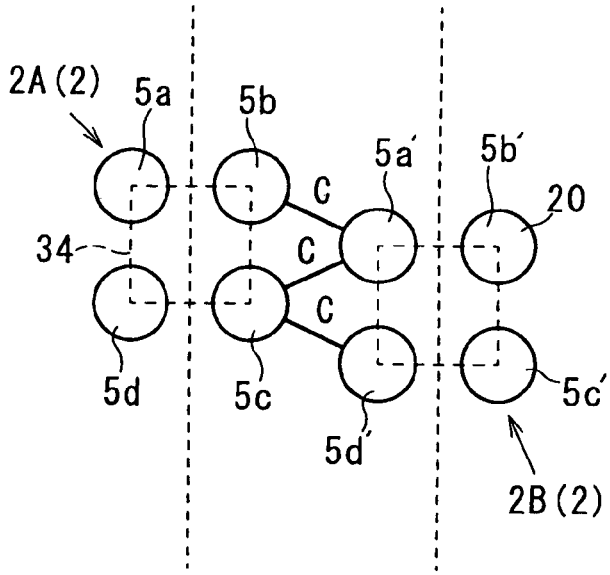

A fuel injection nozzle 1 of a sixth embodiment differs from the fuel injection nozzle 1 of the first embodiment in that the nozzle hole groups 2 of the nozzle 1 of the sixth embodiment are arranged as shown in FIGS. 8A and 8B.

In every nozzle hole group 2 of the sixth embodiment, four solitary nozzle holes 5 are arranged so that their interior mouths 20 form apexes of a square 34. In addition, any neighboring two of the squares 34 are deviated along the axial direction of the nozzle 1. In other words, the nozzle hole groups 2 open their interior mouths 20 on an upper circumference and a lower circumference alternately.

Each nozzle hole group 2 of which the interior mouths 20 are located on the upper circumference is referred to as a first nozzle hole group 2A. Each nozzle hole group 2 of which the interior mouths 20 is located on the lower circumference is referred to as a second nozzle hole group 2B. The four solitary nozzle holes 5 belonging to each first nozzle hole group 2A are referred to as solitary nozzle holes 5*a*, 5*b*, 5*c*, and 5*d*. The three solitary nozzle holes 5 belonging to each second nozzle hole group 2B are referred to as solitary nozzle holes 5*a*', 5*b*', 5*c*', and 5*d*'.

In this case, three inter-group intervals between the first nozzle hole group 2A and the second nozzle hole group 2B adjacent to the first nozzle hole group 2A equal the group distance C. The three inter-group intervals are intervals between the solitary nozzle hole 5*b* and the solitary nozzle hole 5*a*', between the solitary nozzle hole 5*c* and the solitary nozzle hole 5*a*', and between the solitary nozzle hole 5*c* and the solitary nozzle hole 5*d*'.

In addition, the group distance C equals the in-group hole distance $\alpha$. The mouth inner diameter d, the in-group hole distance $\alpha$, and the amount $\beta$ of deviation along the axial direction between the neighboring nozzle hole groups 2A and 2B have a relation represented by an equation $\beta-0.5\times(\alpha+d)$.

Effect of Sixth Embodiment

As described above, each nozzle hole group 2 has four solitary nozzle holes 5, and the three inter-group intervals between the first nozzle hole group 2A and the second nozzle hole group 2B equal the group distance C. In the case that each nozzle hole group 2 includes four solitary nozzle holes 5, the number of inter-group intervals equaling the group distance C has been conventionally two at a maximum. Therefore, by arranging the nozzle hole groups 2 and solitary nozzle holes 5 to make the number of inter-group intervals equaling the group distance C be three, the dead space can be diminished more effectively than ever and the number of the nozzle hole groups 2 can be increased than ever. As a result, in the case that each nozzle hole group 2 includes four solitary nozzle holes 5, the dead space can be diminished more effectively than ever and the number of the nozzle hole groups 2 can be increased than ever.

In addition, the mouth inner diameter d, the in-group hole distance $\alpha$, and the deviation amount $\beta$ have a relation represented by an equation $$\beta=0.5\times(\alpha+d).$$

In the case that each nozzle hole group 2 has four solitary nozzle holes 5, the dead space between two nozzle hole groups 2 becomes smallest when the relation $\beta=0.5\times(\alpha+d)$ is satisfied. Therefore, by arranging the nozzle hole groups 2 to achieve the relation $\beta=0.5\times(\alpha+d)$, the dead space can be diminished.

In the case that each nozzle hole group 2 has four solitary nozzle holes 5 and the relation $\beta\geqq1.5\times(\alpha+d)$ is satisfied, the dead space becomes smaller as the deviation amount $\beta$ becomes larger. Therefore, by arranging the nozzle hole groups 2 to achieve the relation $\beta\geqq1.5\times(\alpha+d)$, the dead space can be diminished.

(Modification)

Figure 10A:
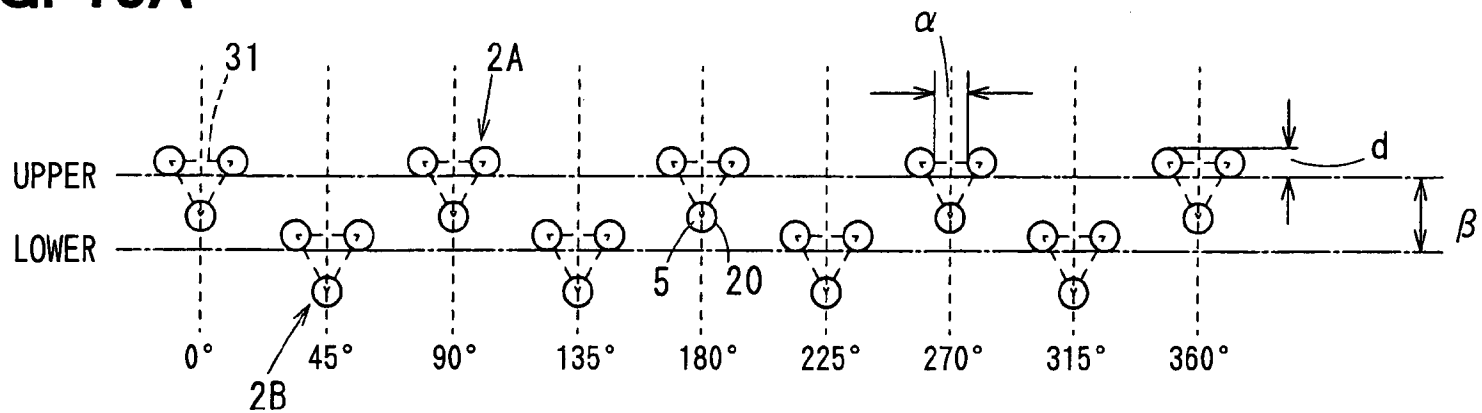
FIGS. 10A and 10B are expansion views showing arrangement of nozzle hole groups on an interior surface of a fuel injection nozzle according to a modification of the embodiments.
Figure 10B:
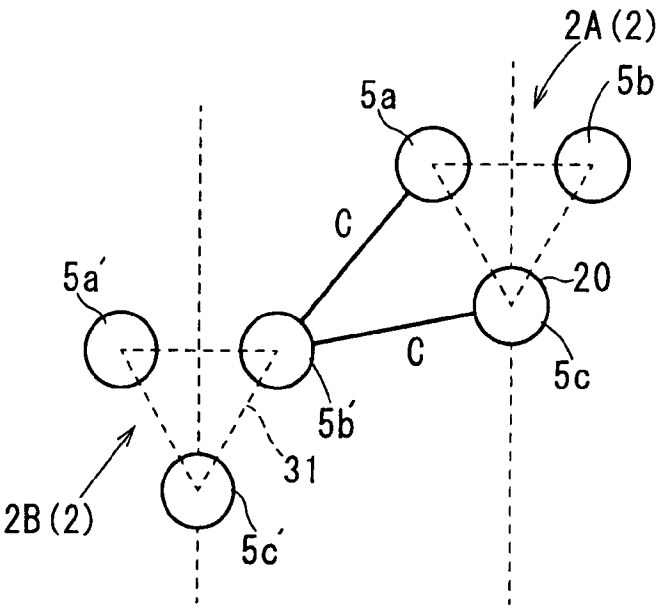
Figure 11:
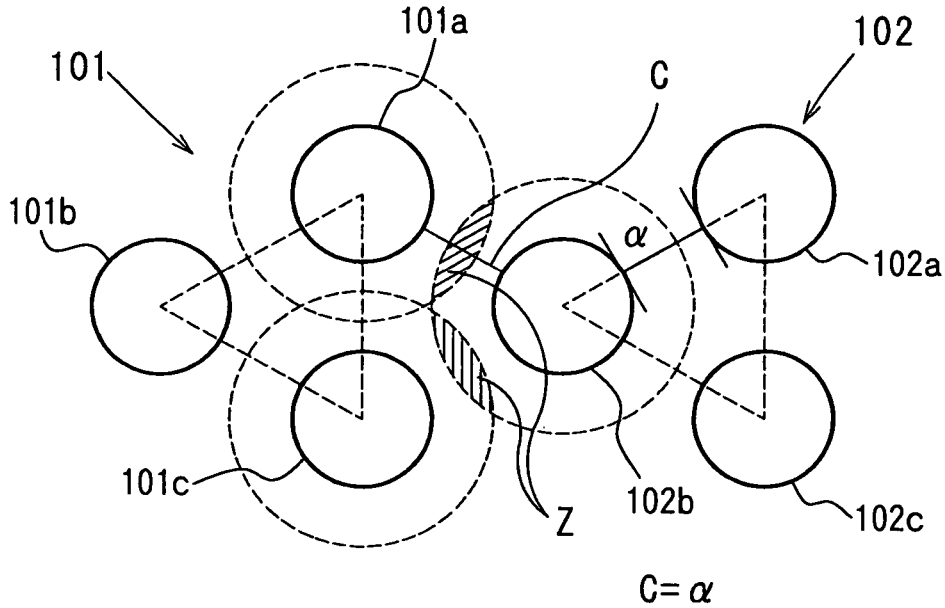
FIG. 11 shows a competition area Z in the nozzle where a group distance C equals the in-group hole distance $\alpha$.
Figure 12:
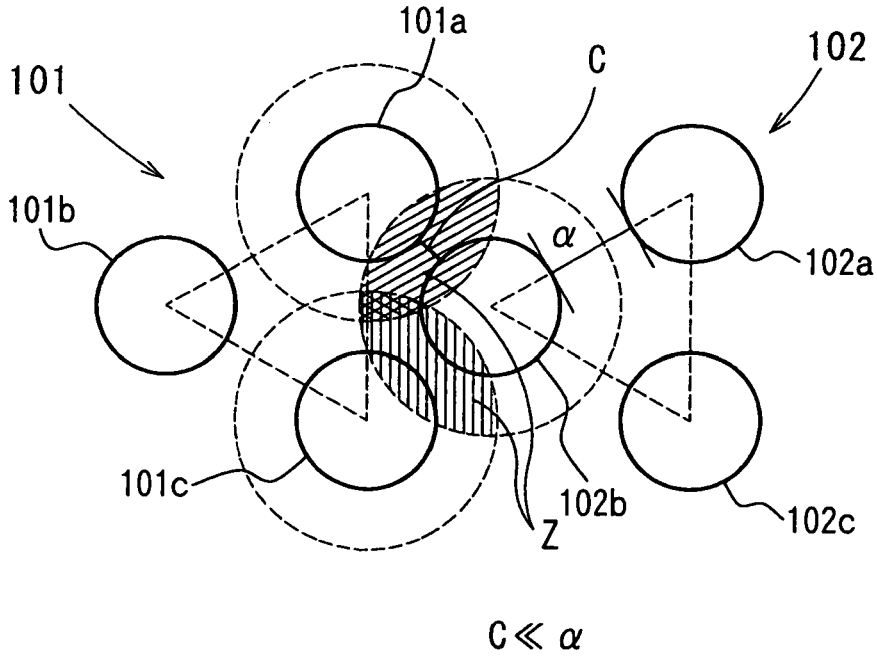
FIG. 12 shows a competition area Z in the nozzle where a group distance C is far smaller than the in-group hole distance $\alpha$.

As shown in FIGS. 10A and 10B, the group distance C may be larger than the in-group distance $\alpha$, as long as a relation $C/\alpha\geqq0.8$ is satisfied. In order to achieve a high power output of the engine, it is preferable to make the group distance C lower than twice the in-group hole distance $\alpha$. It is more preferable to make the group distance C lower than 1.8 times the in-group hole distance $\alpha$. It is furthermore preferable to make the group distance C lower than 1.2 times the in-group hole distance $\alpha$.

In addition, each nozzle hole group 2 may include more than four solitary nozzle holes 5 arranged close to each other.

In addition, the interior mouths 20 of the solitary nozzle holes 5 belonging to each nozzle hole group 2 may form apexes of a shape other than an equilateral polygon.

In addition, in the above embodiments, solitary nozzle holes 5 belonging to a same nozzle hole group 2 are arranged to run or extend in parallel with each other between individual interior surfaces 19 and individual exterior surfaces 21. However, alternatively, the solitary nozzle holes 5 may be arranged to run radially with respect to the axis of the nozzle 1. Furthermore, the solitary nozzle holes 5 may be arranged so that the solitary nozzle holes 5 can be closer with each other on the exterior surfaces 21 than on the interior surfaces 19.

In other words, solitary nozzle holes 5 belonging to a same nozzle hole group 2 may be arranged so that an interval between a portion of one of the solitary nozzle holes 5 and a portion of another one of the solitary nozzle holes 5 gets longer as the portions get away from the interior surface 19 and get close to the exterior surface 21. Alternatively, the solitary nozzle holes 5 belonging to the same nozzle hole group 2 may be arranged so that an interval between a portion of one of the solitary nozzle holes 5 and a portion of another one of the solitary nozzle holes 5 gets shorter as the portions get away from the interior surface 19 and get close to the exterior surface 21.

What is claimed is:

1. A fuel injection nozzle for injecting fuel into an internal combustion engine, the fuel injection nozzle comprising:

a body; and a valve element being movable in the body with respect to an axis of the body for opening and closing a path of the fuel to a sack room between the valve element and the body, the sack room being defined by an interior circumferential surface of the body, wherein the body has a plurality of nozzle hole groups that include a first nozzle hole group and a second nozzle hole group adjacent to the first nozzle hole group, each of the nozzle hole groups including at least two solitary nozzle holes, each of the solitary nozzle holes opening to and facing the sack room at an interior mouth thereof on the interior circumferential surface of the body, and wherein:

an in-group hole distance $\alpha$ is defined to be a minimum interval among intra-group intervals that are formed between peripheral boundaries of interior mouths included within each one group of the nozzle hole groups;

a group distance C is defined to be a minimum interval among inter-group intervals that are formed between (i) individual peripheral boundaries of interior mouths included in the first nozzle hole group and (ii) individual peripheral boundaries of interior mouths included in the second nozzle hole group;

the group distance C is 0.8 or more times as large as the in-group hole distance $\alpha$;

the plurality of nozzle hole groups are arranged to be running radially with respect to the axis of the body so that an interval between a portion of each nozzle hole group and a portion of adjacent nozzle hole group gets longer as the portions get away from the interior circumferential surface of the body and get close to an exterior circumferential surface of the body; and the solitary nozzle holes included in the nozzle hole groups are arranged in the body extending from the interior circumferential surface to an exterior circumferential surface of the body (i) parallel with each other or (ii) radially with respect to the axis of the body while becoming farther separated from each other as the holes become closer to the exterior circumferential surface.

2. The fuel injection nozzle according to claim 1, wherein:

each of the first nozzle hole group and the second nozzle hole group includes two solitary nozzle holes, and three of the inter-group intervals equal the group distance C.

3. The fuel injection nozzle according to claim 1, wherein:

each of the first nozzle hole group and the second nozzle hole group includes at least three solitary nozzle holes whose number is N, and (N−1) or more inter-group intervals equal the group distance C.

4. The fuel injection nozzle according to claim 1, wherein:

an arrangement relation between (i) the solitary nozzle holes of the first nozzle hole group and (ii) the solitary nozzle holes of the second nozzle hole group is rotationally symmetrical with each other.

5. The fuel injection nozzle according to claim 1, wherein:

at least two of the nozzle hole groups are deviated along an axial direction of the body.

6. The fuel injection nozzle according to claim 5, wherein:

the at least two of the nozzle hole groups are the first nozzle hole group and the second nozzle hole group.

7. The fuel injection nozzle according to claim 1, wherein:

two solitary nozzle holes are included in each one group of the nozzle hole groups;

the first nozzle hole group and the second nozzle hole group are deviated along an axial direction of the body by an amount $\beta$ of deviation; and the amount $\beta$ is defined as one of (i) $\beta=0.5\times(\alpha+d)$ and (ii) $\beta\geqq1.5\times(\alpha+d)$, wherein d is an inner diameter of the interior mouths.

8. The fuel injection nozzle according to claim 1, wherein:

four solitary nozzle holes are included in each one group of the nozzle hole groups;

the first nozzle hole group and the second nozzle hole group are deviated along an axial direction of the body by an amount $\beta$ of deviation; and the amount $\beta$ is defined as one of (i) $\beta=0.5\times(\alpha+d)$ and (ii) $\beta\geqq1.5\times(\alpha+d)$, wherein d is an inner diameter of the interior mouths.

9. A fuel injection nozzle for injecting fuel into an internal combustion engine, the fuel injection nozzle comprising:

a body; and a valve element being movable in the body with respect to an axis of the body for opening and closing a path of the fuel to a sack room between the valve element and the body, the sack room being defined by an interior semi-spherical surface of the body, wherein the body has a plurality of nozzle hole groups that include a first nozzle hole group and a second nozzle hole group adjacent to the first nozzle hole group; each of the nozzle hole groups includes at least two solitary nozzle holes; each of the solitary nozzle holes opens to and faces the sack room at an interior mouth thereof on the interior semi-spherical surface of the body;

an in-group hole distance a is defined to be a minimum interval among intra-group intervals that are formed between peripheral boundaries of interior mouths included within each one group of the nozzle hole groups;

a group distance C is defined to be a minimum interval among inter-group intervals that are formed between (i) individual peripheral boundaries of interior mouths included in the first nozzle hole group and (ii) individual peripheral boundaries of interior mouths included in the second nozzle hole group;

the group distance C is 0.8 or more times as large as the in-group hole distance $\alpha$;

the plurality of nozzle hole groups are arranged to be running radially with respect to the axis of the body so that an interval between a portion of each nozzle hole group and a portion of adjacent nozzle hole group gets longer as the portions get away from the interior semi-spherical surface of the body and get close to an exterior semi-spherical surface of the body; and the solitary nozzle holes included in the nozzle hole groups are arranged in the body extending from the interior semi-spherical surface to an exterior semi-spherical surface of the body (i) parallel with each other or (ii) radially with respect to the axis of the body while becoming farther separated from each other as the holes become closer to the exterior semi-spherical surface.

* * * * *